US008142102B2

(12) United States Patent
Wheatley

(10) Patent No.: US 8,142,102 B2
(45) Date of Patent: Mar. 27, 2012

(54) ROAD SURFACE OVERLAY SYSTEM

(75) Inventor: Donald E Wheatley, Ann Arbor, MI (US)

(73) Assignee: Fortress Stabilization Systems, Dexter, MI (US)

( * ) Notice: Subject to any disclaimer, the term of this patent is extended or adjusted under 35 U.S.C. 154(b) by 555 days.

(21) Appl. No.: 12/201,740

(22) Filed: Aug. 29, 2008

(65) Prior Publication Data

US 2009/0214293 A1 Aug. 27, 2009

Related U.S. Application Data

(63) Continuation-in-part of application No. 11/754,144, filed on May 25, 2007.

(60) Provisional application No. 60/809,077, filed on May 26, 2006.

(51) Int. Cl.
*E01C 3/06* (2006.01)

(52) U.S. Cl. ..... 404/31; 404/70

(58) Field of Classification Search ..... 404/18, 404/31, 70, 71

See application file for complete search history.

(56) References Cited

U.S. PATENT DOCUMENTS

| | | | | |
|---|---|---|---|---|
| 3,344,608 | A * | 10/1967 | Mceachran | 405/265 |
| 4,233,356 | A * | 11/1980 | Jacobs | 442/37 |
| 4,540,311 | A * | 9/1985 | Leach | 404/72 |
| 4,916,874 | A | 4/1990 | McCoy et al. | |
| 5,026,609 | A * | 6/1991 | Jacob et al. | 428/489 |
| 5,464,304 | A * | 11/1995 | Dittmar | 404/75 |
| 5,635,263 | A | 6/1997 | Saito | |
| 5,640,825 | A | 6/1997 | Ehsani et al. | |
| 5,649,398 | A | 7/1997 | Isley, Jr. et al. | |
| 5,845,450 | A | 12/1998 | Larsen | |
| 5,894,003 | A | 4/1999 | Lockwood | |
| 5,941,656 | A * | 8/1999 | Sugiyama et al. | 404/20 |
| 6,145,260 | A | 11/2000 | Morton | |
| 6,263,629 | B1 | 7/2001 | Brown, Jr. | |
| 6,418,684 | B1 | 7/2002 | Morton | |
| 6,692,595 | B2 * | 2/2004 | Wheatley et al. | 156/71 |
| 6,746,741 | B2 * | 6/2004 | Wheatley | 428/40.1 |
| 6,846,537 | B2 * | 1/2005 | Wheatley et al. | 428/40.1 |
| 7,232,276 | B2 * | 6/2007 | Oka et al. | 404/31 |
| 2007/0272353 | A1 * | 11/2007 | Wheatley et al. | 156/304.3 |
| 2009/0081913 | A1 * | 3/2009 | Wheatley | 442/103 |
| 2009/0263572 | A1 * | 10/2009 | Wheatley | 427/136 |

FOREIGN PATENT DOCUMENTS

| | | | |
|---|---|---|---|
| JP | 09-003745 | A | 1/1997 |
| JP | 09-057882 | A | 3/1997 |
| JP | 10-033053 | A | 2/1998 |
| JP | 10-037051 | A | 2/1998 |
| JP | 2002-155509 | A | 5/2002 |

OTHER PUBLICATIONS

Coatings for Safety, Procedures for better coatings may help prevent black ice. Concrete Surfaces Magazine (Dec. 1, 2007). http://www.concreteconstruction.net/industry-news.asp?sectionID=718&articleID=634984 (2 pages).

* cited by examiner

*Primary Examiner* — Gary S Hartmann
(74) *Attorney, Agent, or Firm* — Harness, Dickey & Pierce, P.L.C.

(57) ABSTRACT

A road surface overlay system including a road surface, an adhesive material that is applied to a portion or all of the road surface, a woven member including fiber bundles, wherein each of the fiber bundles are substantially embedded in the adhesive material and a layer of aggregate applied onto the woven member and the adhesive material. A method of forming a road surface overlay system is also provided.

18 Claims, 12 Drawing Sheets

ROAD SURFACE OVERLAY SYSTEM

CROSS-REFERENCE TO RELATED APPLICATIONS

This application is a Continuation-in-Part of U.S. application Ser. No. 11/754,144 filed on May 25, 2007 which claims the benefit of U.S. Provisional Application No. 60/809,077 filed on May 26, 2006. The disclosure of the above application is incorporated herein by reference.

FIELD

The present disclosure relates to the treatment of bridge and road surfaces and more particularly, to a method of sealing seams and repairing cracks in bridge and road surfaces.

BACKGROUND

The statements in this section merely provide background information related to the present disclosure and may not constitute prior art.

Segmented bridges have been used for many years as cost effective and structurally sound bridge architecture. A typical segmented bridge may include pre-constructed bridge segments that are formed in predetermined lengths of for example 10 feet and full road widths of over 10 feet and more typically over 20 feet wide. The bridge segments are butted end to end and supported primarily by an interior cable system that runs through passages formed within the concrete bridge segments. A series of bridge segments comprise a bridge span that extends from one pillar to another. It is important to seal the seam that is created at the location where two bridge segments are butted together to prevent water from penetrating the seam and getting to the cable system where the water can cause corrosion of the support cables within the bridge segments. A prior method of sealing the seam has included cutting a groove along the upper surface of the bridge segments along the seam and filling the cut groove with an epoxy. However, the epoxy filled grooves are still capable of leakage failure and it is desirable to provide a cost effective and improved method of sealing the seams between the bridge segments.

Additionally, repairing a distressed road surface often involves replacement of concrete, asphalt paving or asphalt patching, and overlay systems. These methods for repairing a distressed road surface have many disadvantages. Patching material generally provides a temporary repair, over time the patch deteriorates and the road requires subsequent repair. Replacing concrete and asphalt paving are costly and time consuming. These projects are halted during the winter months in regions where the temperatures are below freezing. Overlay repair is problematic because any movement that occurs in the underlying road surface will produce stress in the overlay and can cause physical tearing of the overlay if the stress in the overlay exceeds the tensile strength of the overlay material.

SUMMARY

The present disclosure provides methods and apparatus for sealing the seams between bridge segments or any other road segments. Methods can optionally include cutting a groove along an upper surface of the bridge or road segments along a seam and filling the cut groove with an epoxy. According to the present disclosure, the epoxy is applied on opposite sides of the seam and a fibrous material is applied to the surface so as to span over the seam for the length of the seam. According to another aspect of the present disclosure, the surface of the bridge or road segments along the seam may be etched or otherwise cleaned in order to enhance the adhesive ability of the epoxy.

The present disclosure also provides a road surface overlay system including a road surface, an adhesive material that is applied to a portion or all of the road surface, a woven member including fiber bundles, wherein each of the fiber bundles are substantially embedded in the adhesive material and a layer of aggregate applied onto the woven member and the adhesive material. Additionally, a method of forming a road surface overlay system that includes the steps of applying an epoxy adhesive to a desired area of the road surface, applying a woven member on to the epoxy adhesive while the epoxy adhesive remains uncured, and applying a layer of aggregate onto the woven member and the epoxy adhesive.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
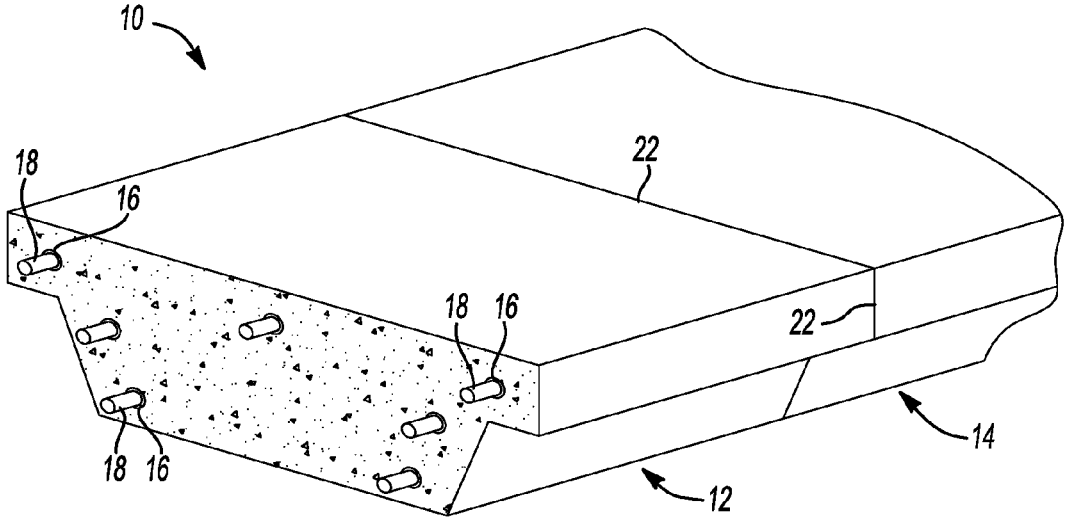
FIG. 1 is a partial perspective view of a pair of cement segments and cables of a segmented bridge.

The following description is merely exemplary in nature and is not intended to limit the present disclosure, application, or uses. It should be understood that throughout the drawings, corresponding reference numerals indicate like or corresponding parts and features.

Figure 3:
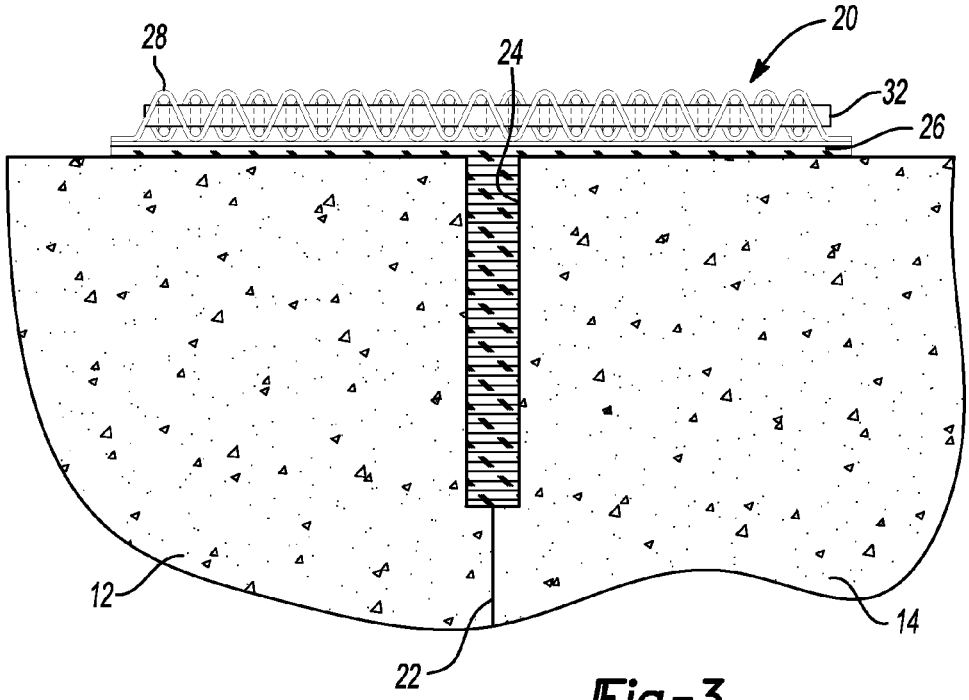
FIG. 3 is a cross-sectional view taken along line 3-3 of FIG. 2.
Figure 2:
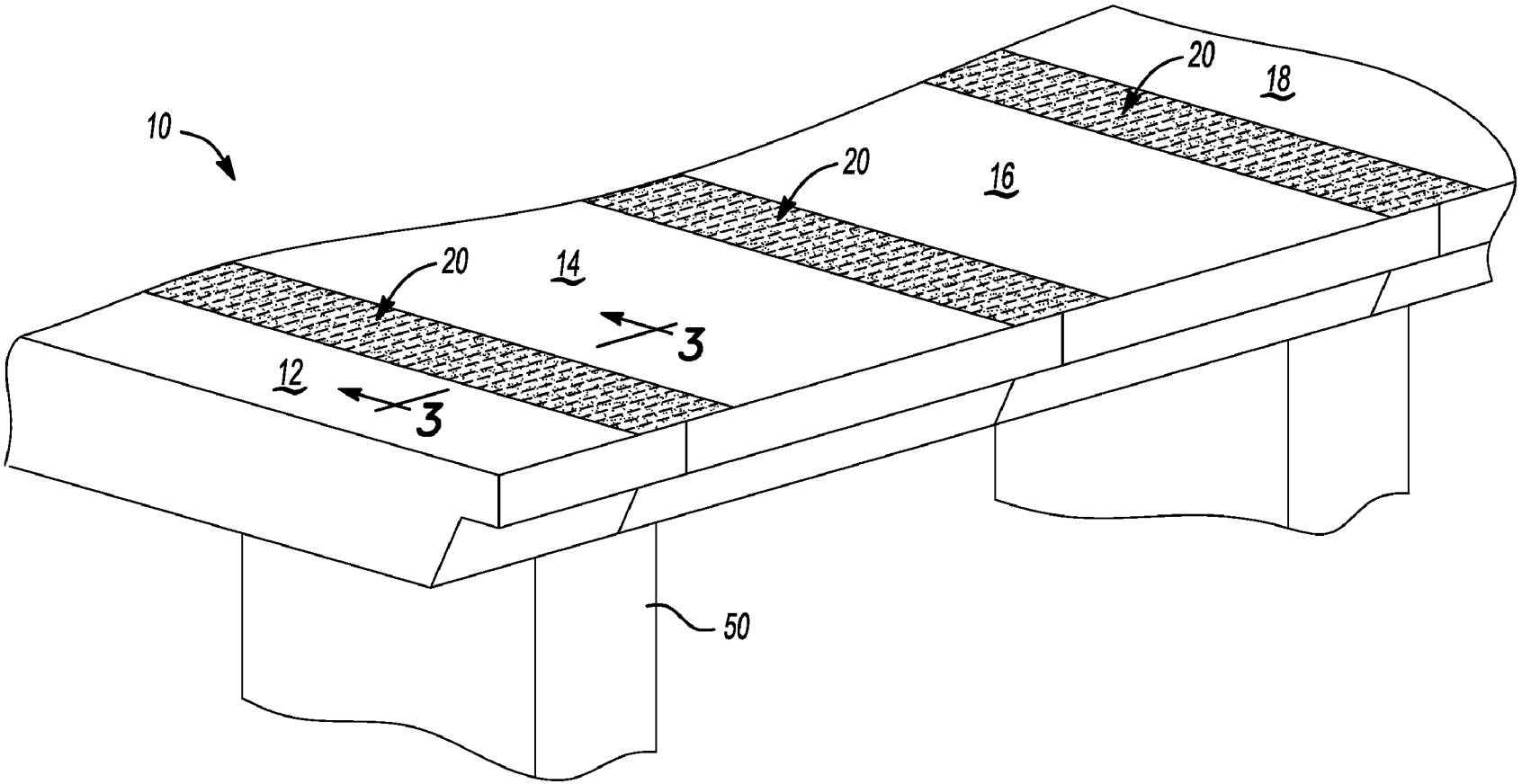
FIG. 2 is a partial perspective of a pair of cement segments, cables, and a sealed seam of a segmented bridge according to some embodiments of the present disclosure.
Figure 4:
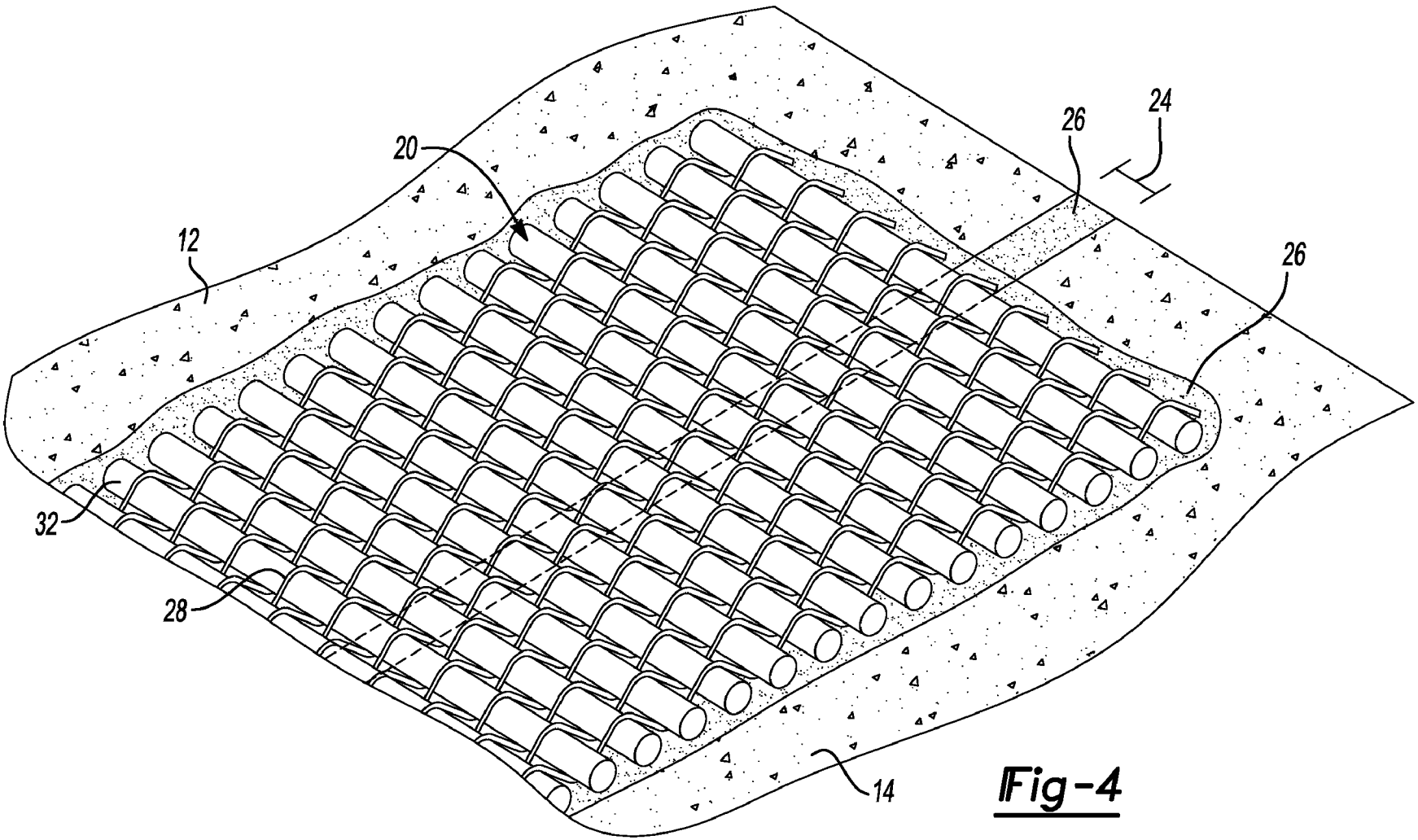
FIG. 4 is a perspective view of a fibrous material spanning a gap between a pair of cement segments and in contact with an adhesive according to some embodiments of the present disclosure.
Figure 5:
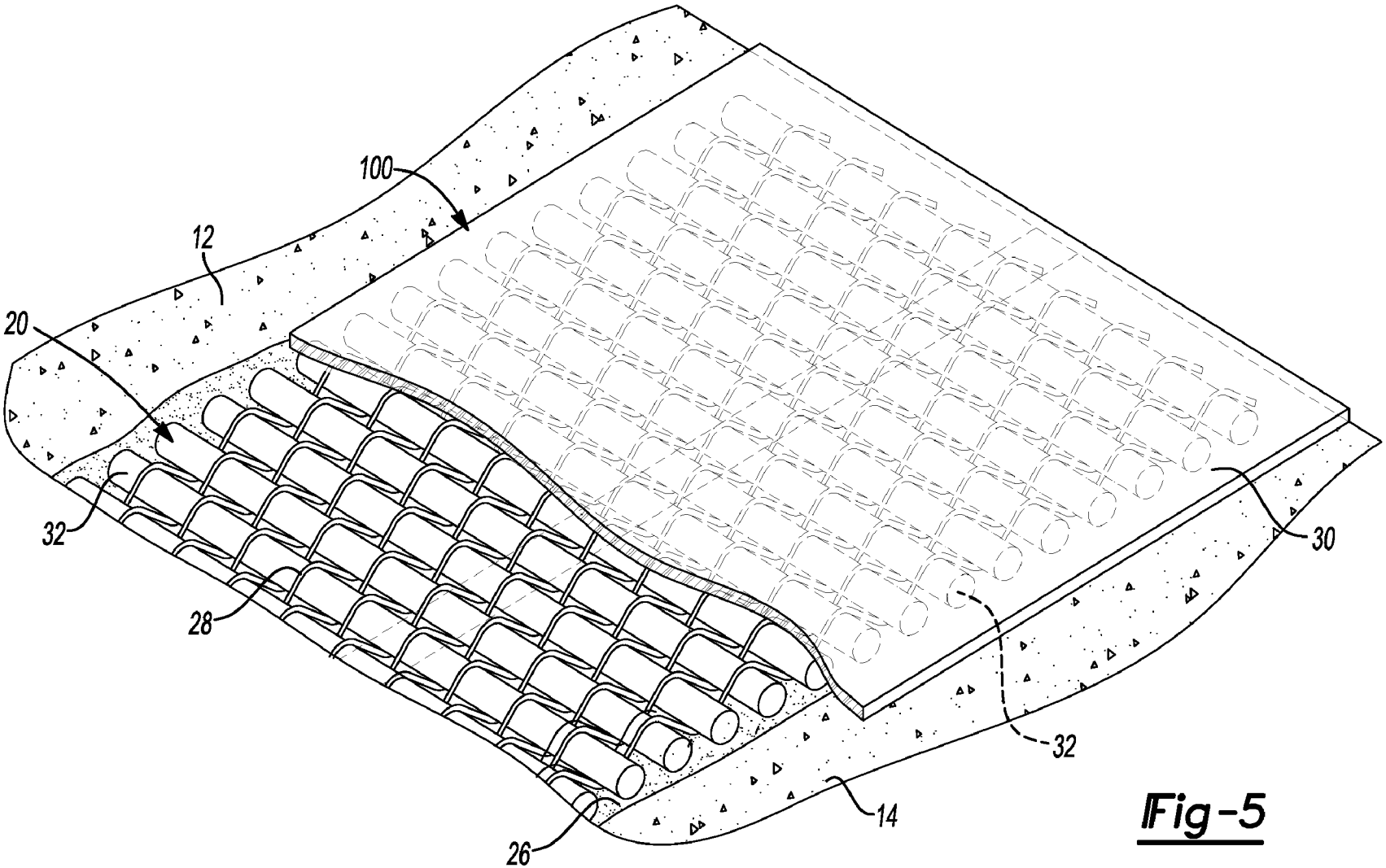
FIG. 5 is a perspective view of a sealed seam according to some embodiments of the present disclosure.

With reference to FIGS. 1-3, a portion of a segmented bridge 10 is shown including a first pre-constructed concrete bridge segment 12 and a second concrete bridge segment 14 that are shown butted together. The bridge segments 12, 14 each include passages 16 formed therein that receive a cable system (cables 18) that provides the primary support for the bridge segments 12, 14 as they extend between spaced pillars 50. A seam 22 is disposed between the bridge segments 12, 14. Optionally, a groove 24 can be cut or otherwise formed in the upper surface of the first and second bridge segments along the seam 22. The groove 24 can be filled with an epoxy adhesive material 26 such as an epoxy, an urethane sealant, a silicone sealant or other suitable sealants or combinations thereof.

An epoxy or other suitable adhesive material 26 is then applied along the surface of the bridge segments 12, 14 along the seam 22 and extending several inches therefrom. Preferably, the adhesive material 26 extends 2 to 12 inches in each direction on opposite sides of the seam 22. A strip of fibrous material 20 is then applied to the adhesive material 26 along the length of the seam 22. It should be noted that the adhesive material 26 may be applied to the fibrous material 20 or to the bridge segments 12, 14, or both. The fibrous material 20 can include fiber bundles 32 which may include carbon fibers, Kevlar fibers, fiberglass, carbon fibers, poly-parapheneylene tetraphthalamide, para-aramid nylon, aramid fiber, aromatic polyamide, and combinations thereof or other suitable man made and naturally occurring fibers that exhibit satisfactory strength and flexibility characteristics. The fibrous bundles 32 may be secured with a thread (not shown). The fibrous material 20 may include one or more threads 28 that are woven to desired densities to allow proper wetting of the material during application with the adhesive material 26. The fibrous material 20 can also be precoated with the adhesive material 26 and pre-cured to provide a flexible, yet relatively rigid material that aids in application of the fibrous material 20. It is desirable that the adhesive material 26 wets into the fibrous material 20 and/or the spaces between the transverse fiber bundles 32 to provide a fiber reinforced water resistant cover to the seam 22.

Figure 6:
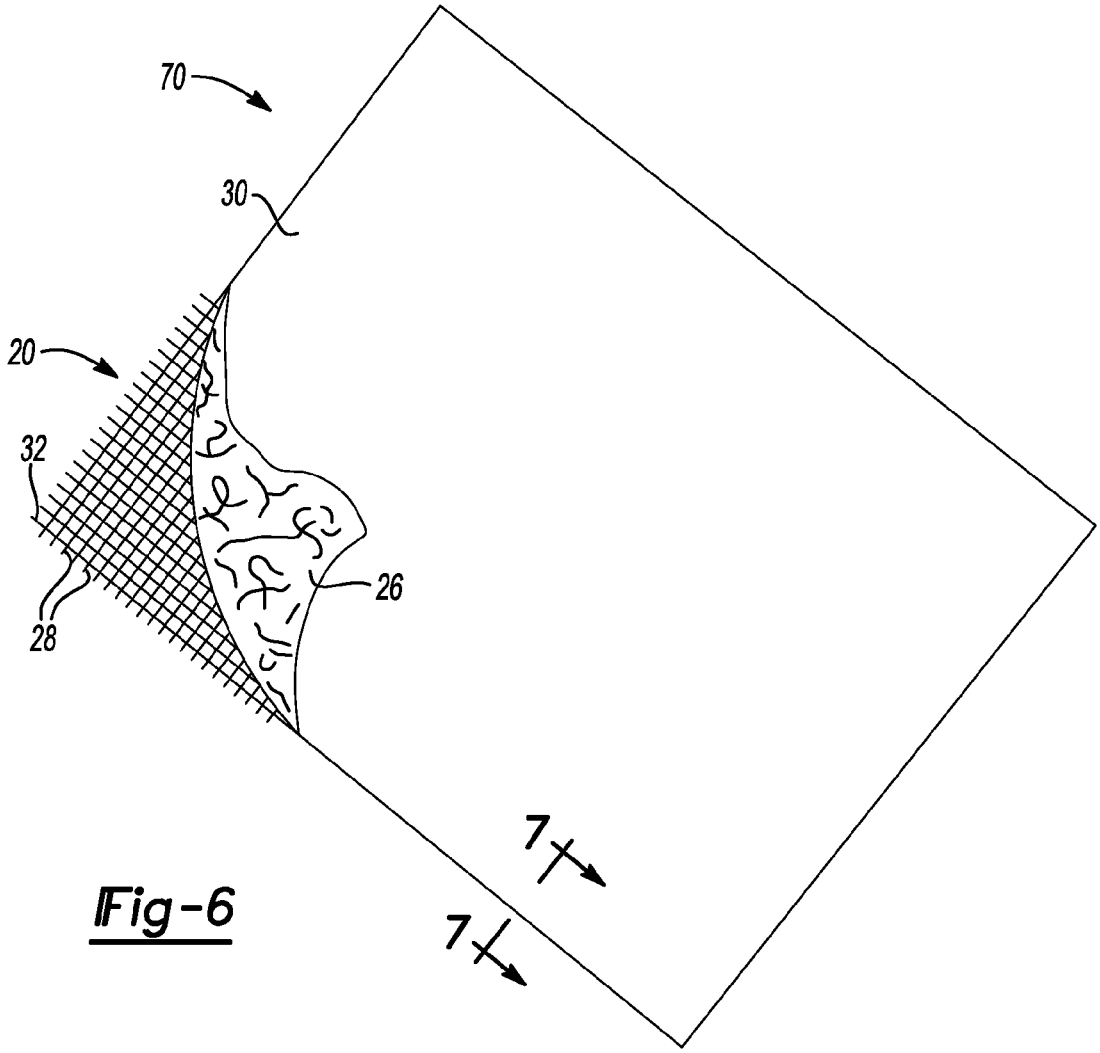
FIG. 6 is a top view of a fibrous material according to some embodiments of the present disclosure.
Figure 7:
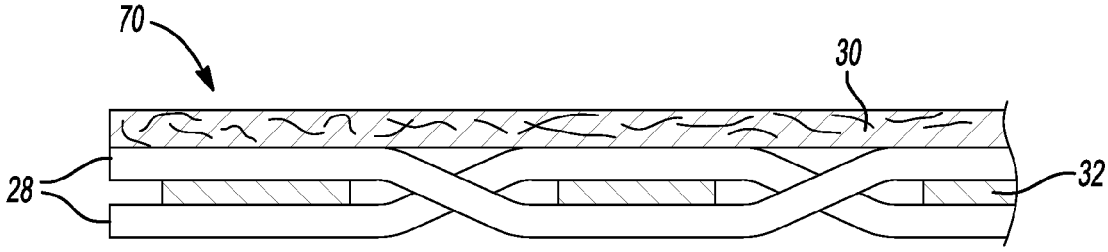
FIG. 7 is a cross-section view taken along lines 7-7.
Figure 8:
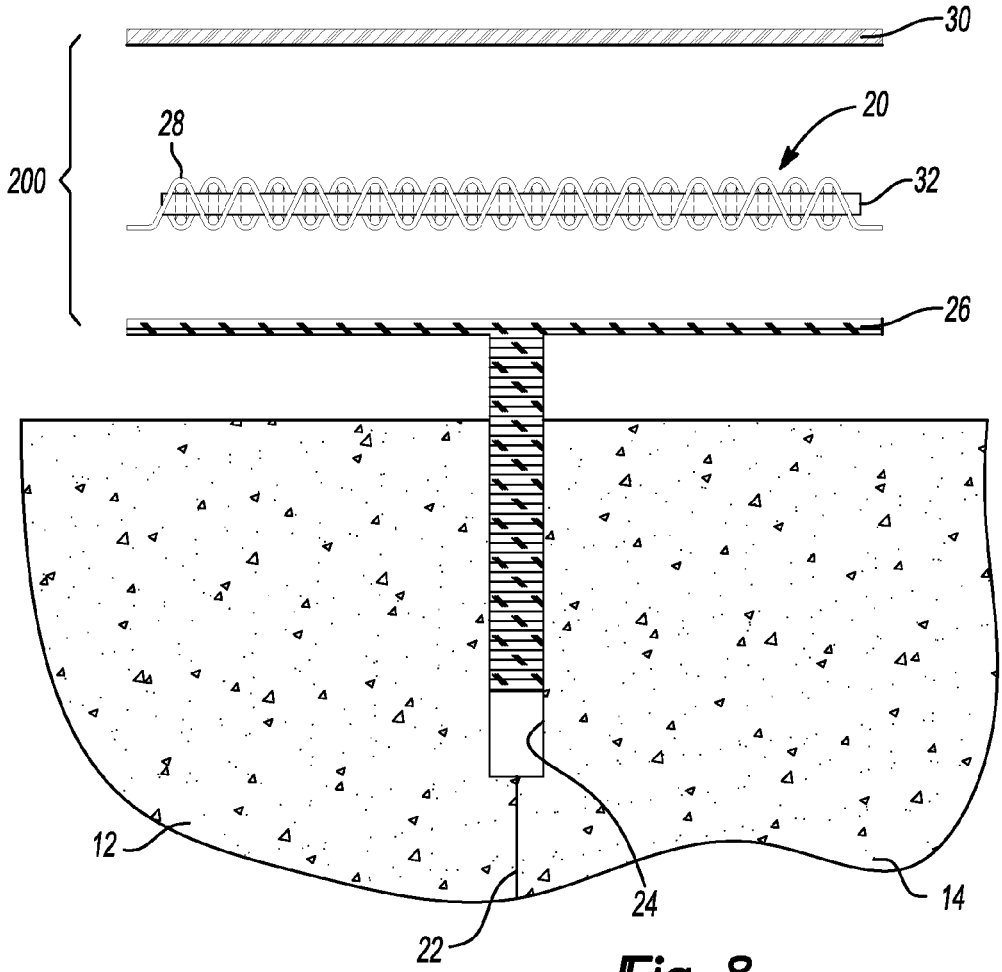
FIG. 8 is an exploded view of FIG. 3.

As shown in FIGS. 6-7, examples are illustrated according to the present disclosure of the rigidified fiber mesh tape 20, that can be used for sealing a seam 22 in a segmented bridge 10. The rigidified fiber mesh tape 20 comprises a number of transverse fibers 32 running the distance of the width of the mesh tape 106 and a number of longitudinal fibers or threads 28. The transverse fibers 32 run parallel to one another and are in tension. As best seen in FIG. 7, the longitudinal threads 28 can be woven into the transverse fibers 32, the longitudinal threads 28 alternating from a position above the transverse fibers 32 to a position below the transverse fibers 32. Alternatively, as best seen in FIG. 8, the longitudinal threads 28 sandwich the transverse fibers 32. In other words, the longitudinal threads 28 can be layered on top and below the transverse fibers 32, providing a fiber mesh 100 with a lower manufacturing cost. A further reduction of manufacturing cost may be achieved by providing only one of the layers of longitudinal threads 28, either on top or below.

Figure 9:
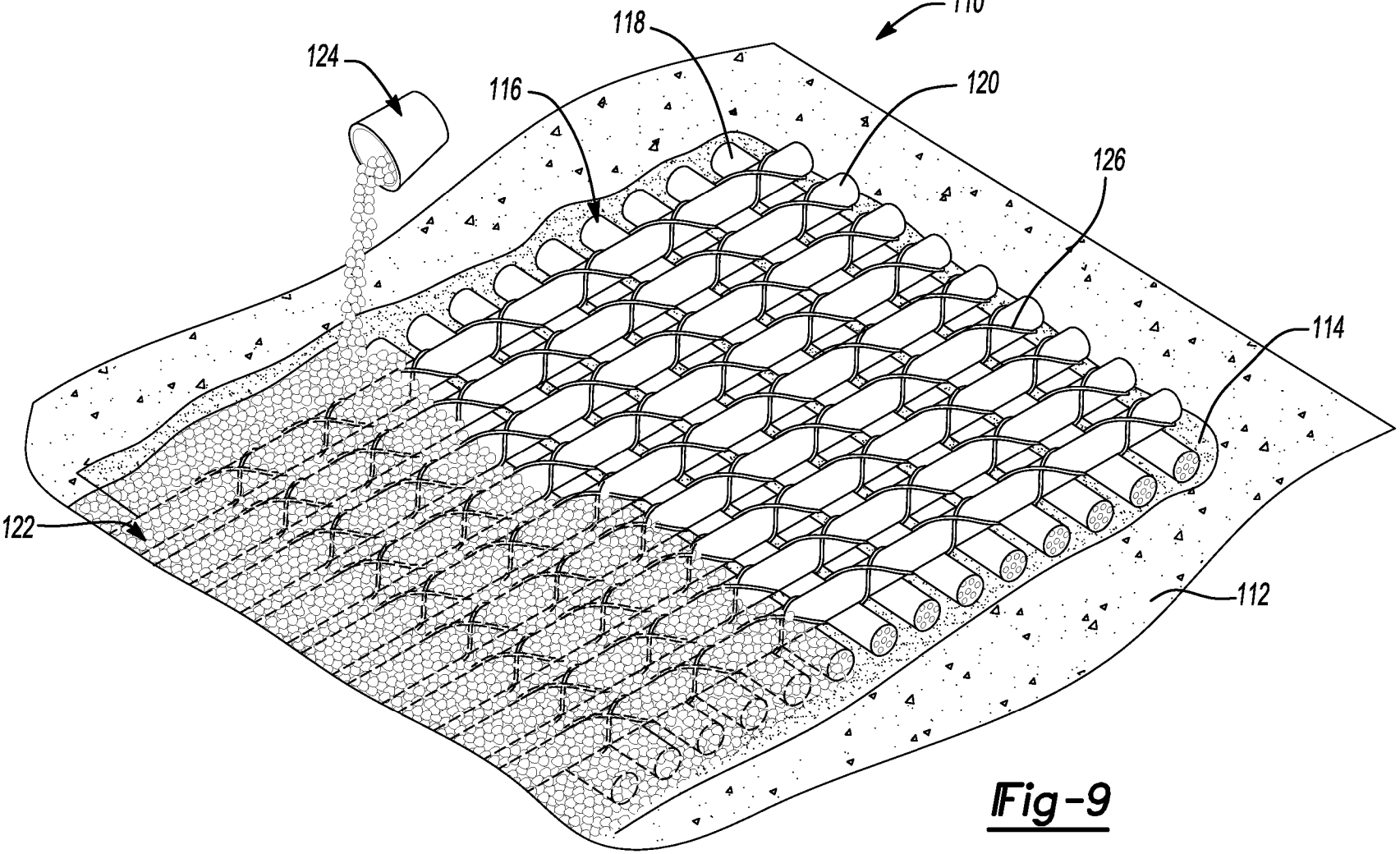
FIG. 9 is a partial perspective view of one embodiment of the road surface overlay system.

The transverse fibers 32 and longitudinal threads 28 may be of any cross-sectional shape, such as flat (ribbon like), rectangular, oval or round. In the same embodiments, the longitudinal threads 28 have a flat cross-section, as seen in FIGS. 7-9, providing a large surface area to contact the segments 12 and providing a low bending stiffness in the plane of the mesh tape 20.

As shown in FIGS. 4-7, the longitudinal threads 28 are generally at 90-degree angles (transverse) to the transverse fibers 32. In some embodiments, the longitudinal threads 28 may be at 45-degree angles to the transverse fibers 32, or some angle between 45-degrees and 90-degrees. In a 45-degree fiber orientation, the longitudinal threads 28 tend to be loaded in tension along with the transverse fibers 32.

In some embodiments, the transverse fibers 32 and longitudinal threads 28 may be spaced anywhere from over 1 inch apart to less than 1/32 inches apart so long as the spacing is sufficient to allow adhesive to flow between the fibers 102, 104, discussed herein. The rigidified fiber mesh tape 20 has a roughened surface 38 exposed or produced upon removal of a cover sheet 24, as will be discussed in detail herein. In some embodiments, the transverse fibers 32 and/or the longitudinal thread 28 are made of pre-cured carbon, although any material providing flexibility and tensional strength may be used. Moreover, transverse fibers 32 and longitudinal threads 28 may be of different materials. For example, transverse fibers 32 may be Kevlar or bundles of Kevlar and longitudinal threads 28 may be a nylon or a nylon blend. Other examples of transverse fibers 32 include carbon fibers, poly-parapheneylene tetraphthalamide, para-aramid nylon, aramid fiber, aromatic polyamide, and combinations thereof. In some embodiments, transverse fibers can be in bundles or individual fibers. Other examples of longitudinal threads 28 can include nylon, polyester, polypropylene, nomex, cotton, carbon fibers, poly-parapheneylene tetraphthalamide, para-aramid nylon, aramid fiber, aromatic polyamide, and combinations thereof.

In some embodiments as shown in FIG. 6, the adhesive material 26 (discussed above) is applied to the first surface 36 of the rigidified fiber mesh tape 20 and a thin layer or at least some of the adhesive material 26 remains on the surface 36 of the rigidified fiber mesh tape 20. It should be noted that the openings between the transverse fibers 32 and longitudinal threads 28 remain unobstructed.

As discussed herein, to provide a strong bond between the rigidified fiber mesh tape 20, it is important to have the surface of the rigidified fiber mesh tape 20 clean and roughed. In order to keep the surface clean and provide a roughened surface, over the layer of adhesive material 26, on the surface 36 (and optionally on the surface 38), is applied a flexible cover sheet 30 of impermeable sheet or film comprising textile, nylon, a polymeric or plastic material. The side of the cover sheet 30 in contact with the adhesive material 26 preferably exhibits a texture, such as a woven texture surface 39. The carbon fiber 13 or rigidified fiber mesh tape 20, with the adhesive material 26 and the cover sheet 30 applied, are subject to high temperature and pressure, via known techniques, allowing the adhesive material 26 to cure. Once the adhesive material 26 has cured, the result is a rigid carbon fiber sheet or rigidified fiber mesh tape 20 having a removable cover sheet 30 covering one or both surfaces thereof. This rigid carbon fiber sheet or rigidified fiber mesh tape 20 may then be cut or sawn into the desired sizes. In this form, the rigidified fiber mesh tape 20 can be stored and/or shipped to a job site for use. With the rigidified fiber mesh tape 20, the resin applied during the manufacture of the open fabric tends to fill the window between the mesh. When the textured cover sheet is removed, these windows remain adhered to the cover sheet and leave the openings clear. Thus, the cover sheet provides both a roughened surface, but also open windows.

At the job site, the cover sheet 30 prevents dirt, grease and other debris from coming into contact with the rigidified fiber mesh tape 20. Immediately prior to use, the cover sheet 30 is removed, or more accurately peeled away, from the surface 36 of the carbon fiber strip or rigidified fiber mesh tape 20 leaving exposed a clean roughened surface 38. This roughened surface 38 is a result of at least two factors, individually or in combination. First, the textured surface 39 of the cover sheet 30 causes an impression to be formed in the adhesive material 26 on the surface 36 as it cures. Second, as the cover sheet 30 is removed from the mesh tape 20, some of the adhesive material 26 remains adhered to the plastic sheet 30 and breaks away from the rigidified fiber mesh tape 20.

With the method of the present disclosure, a cost effective and improved method of sealing the seams between bridge segments is provided. It is noted that the sealing method of the present disclosure may also be utilized on road or other bridge surfaces in which grooves or seams are often cut between large concrete or asphalt sections or when road sections are being patched. The use of an adhesive/fibrous seal along the seams between non-movable road or bridge surface sections can prevent the intrusion of water that can cause further cracking along the seams especially in colder climates.

As illustrated in the drawings, the rigidified fiber mesh tape 20 can be pre-cut and can be provided in suitable lengths for their intended use. As will be appreciated by those skilled in the art, a large sheet may be cut to the required sizes before adhering it to reinforce a structural element 12. In some embodiments, the fiber mesh tape 20 can be stored and/or shipped in rolls. In some embodiments, a fit can include adhesive material 26, mesh tape 20 and cover sheet 30, as illustrated in FIG. 8. In some embodiments, the fit can include a cutting tool for cutting mesh tape 20 into desired shapes.

Figure 10:
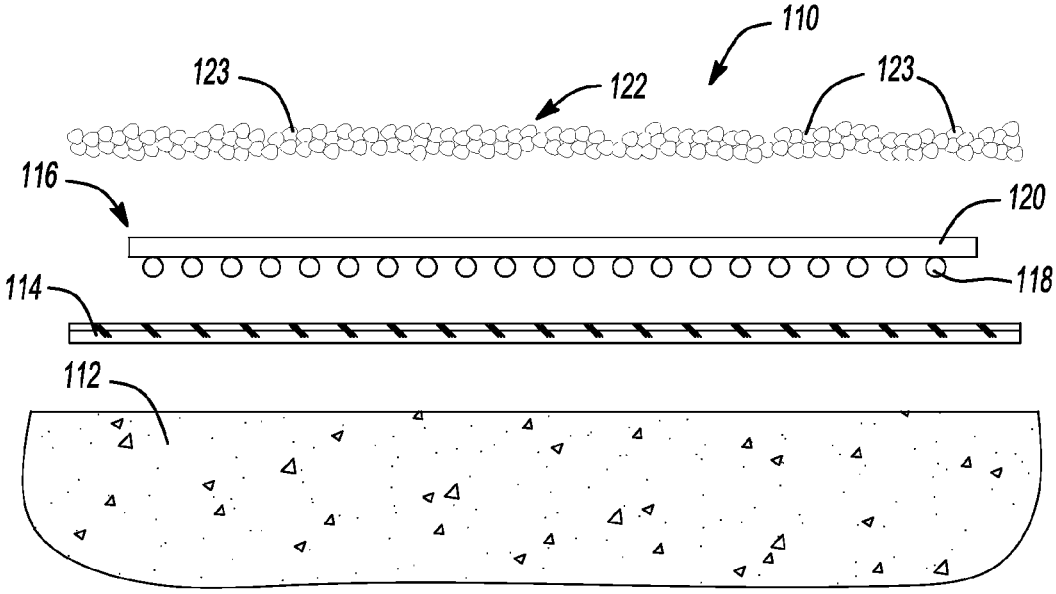
FIG. 10 is a side view of another embodiment of the road surface overlay system.
Figure 11:
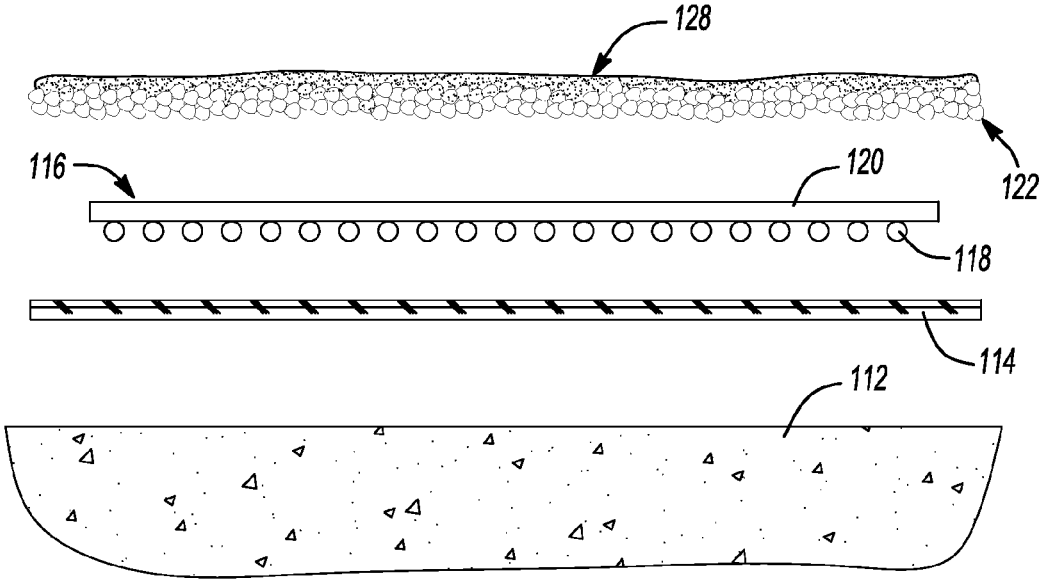
FIG. 11 is a side view of the road surface overlay system in another embodiment according to the principles of the present disclosure.

With reference to FIGS. 9-11 a road surface overlay system 110 is shown including a road surface 112. The road surface 112 may include concrete, asphalt, or any other suitable material. The road surface 112 may include bridge structures, highways, ingress or egress ramps, streets, or any other suitable surface. An epoxy or other suitable adhesive material 114 is applied to a desired area of the road surface 112 after cleaning the road surface 112. The road surface may be cleaned by etching, steam cleaning, acid washing, sand blasting, power washing, for example. While the adhesive material 114 is uncured, a woven member 116 is then applied to the adhesive material 114. The adhesive material 114 may be an epoxy, urethane sealant, silicone sealant or any adhesive material suitable for applying to a road surface 112. The adhesive material 114 may also waterproof the road surface 112. The woven member 116 may be applied in rolls, sheets, grids or any other suitable means known in the art. The woven member 116 may be applied using automated equipment, manual equipment or by hand.

The woven member 116 may include a single transverse fiber bundle 118 and a single longitudinal fiber bundle 120 attached in any manner known to one skilled in the art, for example, in an over-lay, interwoven, stitched, or bonded. Alternatively, the woven member 116 may include a series of transverse fiber bundles 118 and a series of longitudinal fiber bundles 120. It is understood that securing the transverse fiber bundles 118 to the longitudinal fiber bundles 120 using thread, adhesive or any other means suitable in the art is comprehended by the term woven member 116. The woven member 116 may be immersed into the adhesive material 114 to improve the adhesive bond of the woven member 116 and the adhesive material 114. The longitudinal fiber bundles 120 are generally at 90-degree angles (transverse) to the transverse fiber bundles 118. In some embodiments, the longitudinal fiber bundles 120 may be at 45-degree angles to the transverse fiber bundles 118, or some angle between 45-degrees and 90-degrees. In a 45-degree fiber orientation, the longitudinal fiber bundles 120 tend to be loaded in tension along with the transverse fiber bundles 118.

The transverse and longitudinal fiber bundles 118, 120 may include carbon fibers, Kevlar fibers, fiberglass, carbon fibers, poly-parapheneylene tetraphthalamide, para-aramid nylon, aramid fiber, aromatic polyamide, and combinations thereof or other suitable man made and naturally occurring fibers that exhibit satisfactory strength and flexibility characteristics. It is appreciated that the transverse and longitudinal fiber bundles 118, 120 may be bundles or individual fibers.

A layer of aggregate 122 can be applied over the woven member 116 so as to be embedded in the adhesive material 114. The layer of aggregate 122 can be applied using a spreading device 124 or any other suitable means known in the art. The layer of aggregate 122 provides a covering over the woven member 116. The layer of aggregate 122 may protect the woven member 116 from deterioration caused by traffic and severe weather. The aggregate material may be a stone, a mineral, a compound or any other suitable material known in the art. The thickness of the layer of aggregate 122 may vary by application and may be adjusted to any suitable thickness desired by one skilled in the art. The woven member 116 only requires minimal coverage because of its non-corrosive properties. When the layer of aggregate 122 is applied over the woven member 116 and the adhesive material 114, a series of valleys and voids 123 are formed within the layer of aggregate 122. After the adhesive material 114 has cured, a de-icing chemical (not shown) may be applied to the layer of aggregate 122. The de-icing chemical may lower the freezing point on the road surface 112, and thus prevent ice from forming. The de-icing chemical will go into the series of valleys and voids 123 and remain there. The de-icing chemical may be selected from liquid calcium chloride, liquid magnesium chloride, and liquid sodium chloride, for example. The de-icing chemical can be applied in a liquid form using a sprayer or in a powder form using a spreader, or any other form suitable in the art.

A second layer of adhesive material 128 may also be applied to the layer of aggregate 122 as shown in FIG. 11. The second layer of adhesive material 128 may prevent water from intruding below the road surface overlay system 110. The second layer of adhesive material 128 may be an epoxy, urethane sealant, silicone sealant or any adhesive material suitable for applying to a road surface 112. The second layer of adhesive 128 may provide a water proofing means. Alternatively, the second layer of adhesive 128 may be substituted for a waterproofing material such as a PVC or bitumen with elastomers, for example. In some embodiments, a road surface overlay kit may be provided that includes an adhesive material 114, woven member 116, and a layer of aggregate 122. In some embodiments, the kit can include a cutting tool (not shown) for cutting the woven member 116 into desired shapes and lengths.

Figure 12:
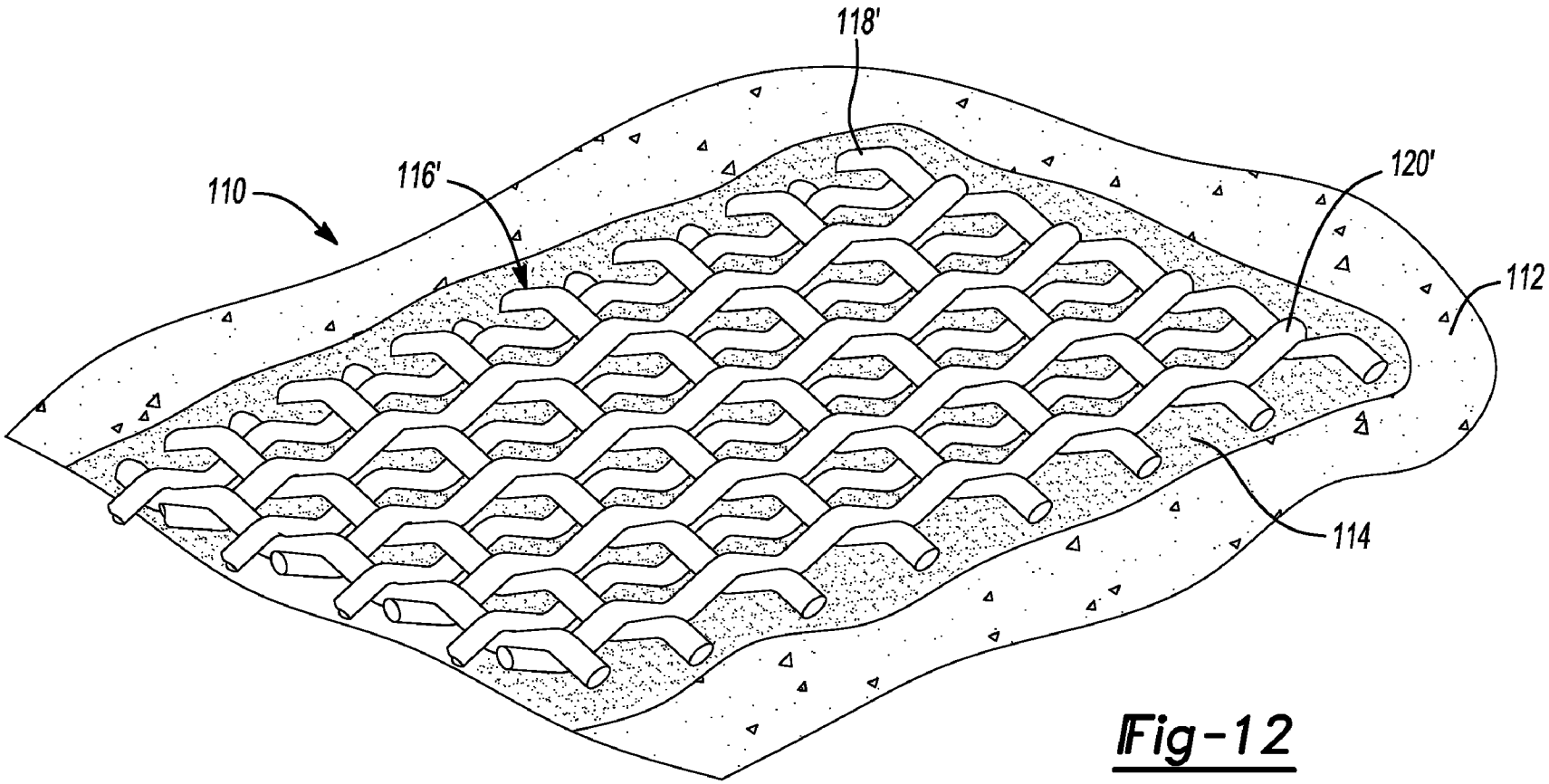
FIG. 12 is a perspective view of a woven material in another embodiment according to the principles of the present disclosure.

With reference to FIG. 12 the woven member 116' is shown in contact with the adhesive material 114 in another embodiment. The woven member 116' includes transverse fiber bundles 118' and longitudinal fiber bundles 120'. The woven member 116' may include transverse fiber bundles 118' and longitudinal fiber bundles 120' attached in any manner known to one skilled in the art, for example, in an over-lay, interwoven, stitched, or bonded. If interwoven, the transverse fiber bundles 118' alternate from a position above the longitudinal fiber bundles 120' to a position below the longitudinal fiber bundles 120'. The longitudinal fiber bundles 120' are generally at 90-degree angles (transverse) to the transverse fiber bundles 118'. The longitudinal fiber bundles 120' may be at 45-degree angles to the transverse fiber bundles 118', or some angle between 45-degrees and 90-degrees.

The transverse and longitudinal fiber bundles 118', 120' may include carbon fibers, Kevlar fibers, fiberglass, carbon fibers, poly-parapheneylene tetraphthalamide, para-aramid nylon, aramid fiber, aromatic polyamide, and combinations thereof or other suitable man made and naturally occurring fibers that exhibit satisfactory strength and flexibility characteristics. The transverse fibers 118' can be in bundles or individual fibers. The transverse fiber bundles 118' and the longitudinal fiber bundles 120' may be woven to desired densities to allow proper adhesive wetting of the woven member 116' during application with the adhesive material 114.

The woven member 116' can also be pre-coated with the adhesive material 114 and thermally cured to provide a flexible, yet relatively rigid material that aids in application of the woven member 116' when applied in sheets. It is desirable that the adhesive material 114 wets into the woven member 116' and/or the spaces between the transverse fiber bundles 118' and the longitudinal fiber bundles 120' in order to provide a fiber reinforced water resistant cover to the road surface 112. If weaving transverse fiber bundles 118' and the longitudinal fiber bundles 120' is undesirable, the transverse fiber bundles 118' may be placed in contact with the longitudinal fiber bundles 120' and secured to each other using thread 126. The transverse fiber bundles 118' and the longitudinal fiber bundles 120' may also be secured to each other by an adhesive material 114. It is understood that securing the transverse fiber bundles 118' to the longitudinal fiber bundles 120' using thread, adhesive or any other means suitable in the art is comprehended by the term woven member 116'.

In some embodiments, the transverse fiber bundles 118' and longitudinal fiber bundles 120' may be spaced anywhere from over 1 inch apart to less than 1/32 inches apart so long as the spacing is sufficient to allow an adhesive material 14 to flow therebetween. The transverse fiber bundles 118' and/or the longitudinal fiber bundles 120' are made of pre-cured carbon, although any material providing flexibility and tensional strength may be used. Moreover, transverse fiber bundles 118' and longitudinal fiber bundles 120' may be of the same or different materials. For example, transverse fiber bundles 118' may be Kevlar or bundles of Kevlar and longitudinal fiber bundles 120' may be nylon or a nylon blend. Other examples of longitudinal fiber bundles 120' include carbon fibers, poly-parapheneylene tetraphthalamide, para-aramid nylon, aramid fiber, aromatic polyamide, and combinations thereof. Other examples of transverse and longitudinal fiber bundles 118', 120' can include nylon, polyester, polypropylene, nomex, cotton, carbon fibers, poly-parapheneylene tetraphthalamide, para-aramid nylon, aramid fiber, aromatic polyamide, and combinations thereof.

Figure 13:
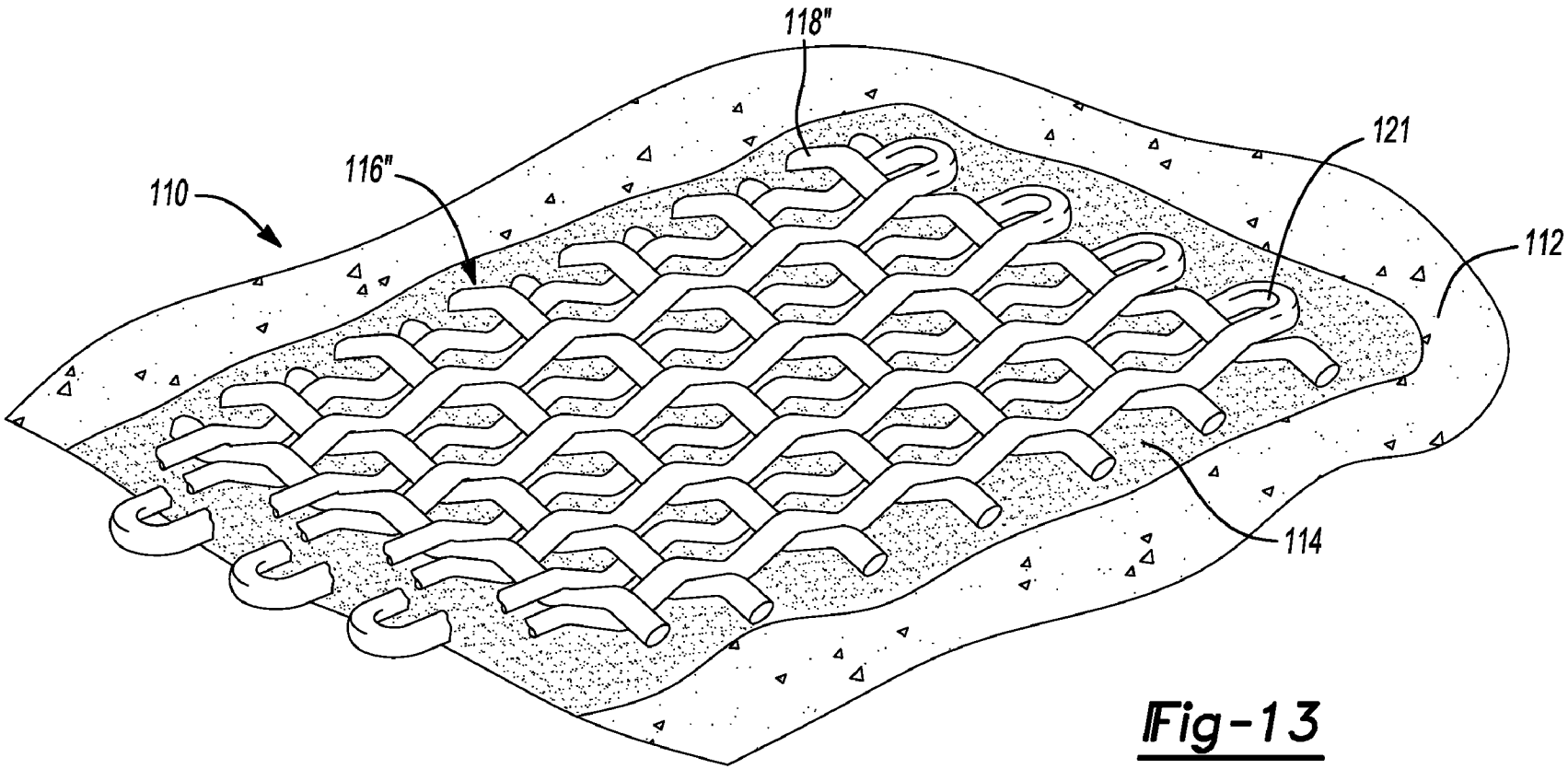
FIG. 13 is a perspective view of a woven member in another embodiment according to the principles of the present disclosure.

With reference to FIG. 13, another embodiment of the woven member 116" is shown in contact with the adhesive material 114. A first longitudinal fiber bundle 121 may be aligned and woven in alternating longitudinal directions in a serpentine fashion. The length of the first longitudinal fiber bundle 121 may be modified to provide desired coverage of any road surface 112. The transverse fiber bundles 118" may be aligned in a transverse direction and woven into each of the rows of the first longitudinal fiber bundle 121 where the transverse fiber bundles 118" may alternate from a position above the first longitudinal fiber bundle 121 to a position below the first longitudinal fiber bundle 121. Alternatively, the transverse fiber bundles 118" may be in contact with the first longitudinal fiber bundle 121 and secured to each other using thread 126 as shown in FIG. 9. The transverse fiber bundles 118" may be in contact with the first longitudinal fiber bundle 121 and secured by an adhesive material 114.

Alternatively, a first transverse fiber bundle (not shown) may be used rather than a plurality of transverse fiber bundles 118". The first transverse fiber bundle may be aligned and woven in alternating transverse directions in a serpentine fashion. The length of the first transverse fiber bundle may be modified to provide desired coverage of any road surface 112. The first transverse fiber bundle may be aligned in a transverse direction and woven into the first longitudinal fiber bundle 121. The first transverse fiber bundle may be in contact with the first longitudinal fiber bundle 121 and secured to each other using thread 126 as shown in FIG. 9. Alternatively, the first transverse fiber bundle may be in contact with the first longitudinal fiber bundle 121 and secured to the first longitudinal fiber bundle 121 using an adhesive material 114. It is understood that securing the transverse fiber bundles 118' to the longitudinal fiber bundles 120' using thread, adhesive or any other means suitable in the art is comprehended by the term woven member 116".

Figure 14:
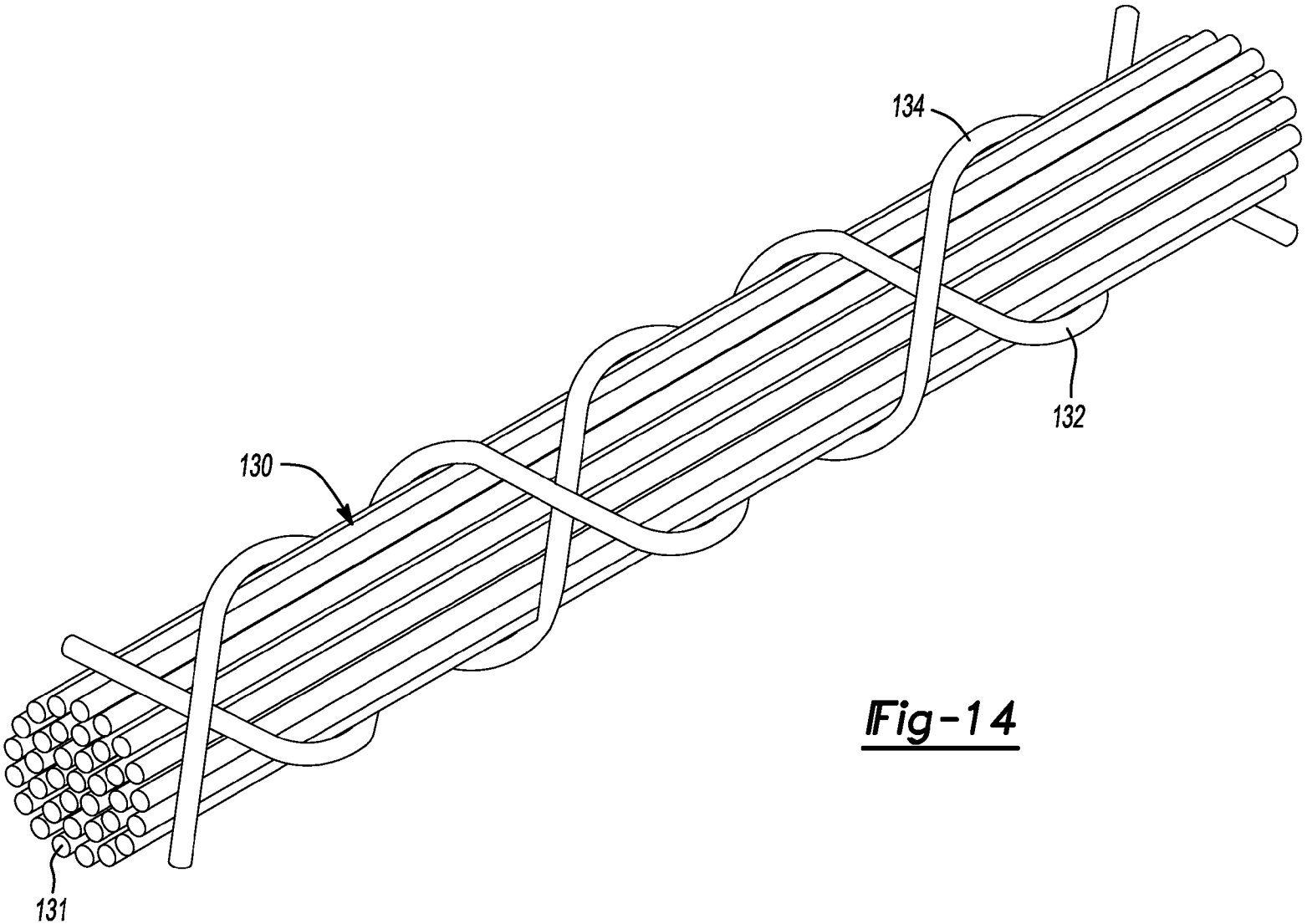
FIG. 14 is a perspective view of a woven member including a plurality of threads.

With reference to FIG. 14, a first fiber bundle 130 is shown including a first thread 132 and a second thread 134. The first fiber bundle 130 is shown in a round cross-sectional shape but the first fiber bundle 130 may be any cross-sectional shape, such as flat (ribbon like), rectangular, oval, or any suitable shape known in the art. The first fiber bundle 130 contains a plurality of fiber strands 131. The plurality of fiber strands 131 may be aligned adjacently and held together by at least one of a first thread 132 and a second thread 134. The plurality of fiber strands 131 may be held together using an adhesive material. Alternatively, the plurality of fiber strands 131 may be woven together. Weaving the plurality of fiber strands 131 may eliminate the need for an adhesive or thread. The plurality of fiber strands 131 may be held together in any suitable manner known in the art.

The first thread 132 and the second thread 134 may include carbon fibers, Kevlar fibers, fiberglass, carbon fibers, poly-parapheneylene tetraphthalamide, para-aramid nylon, aramid fiber, aromatic polyamide, and combinations thereof or other suitable man made and naturally occurring threads that exhibit satisfactory strength and flexibility characteristics. The first thread 132 may be wrapped around the first fiber bundle 130 in a first direction and the second thread 134 may be wrapped around the first fiber bundle 130 in a second direction that is different than the first direction.

The first thread 132 and the second thread 134 may include carbon fibers, Kevlar fibers, fiberglass, carbon fibers, poly-parapheneylene tetraphthalamide, para-aramid nylon, aramid fiber, aromatic polyamide, and combinations thereof or other suitable man made and naturally occurring threads that exhibit satisfactory strength and flexibility characteristics. The first thread 132 may be wrapped around the first fiber bundle 130 in a first direction and the second thread 134 may be wrapped around the first fiber bundle 130 in a second direction that is different than the first direction. Alternatively, a first thread 132 may be wrapped around the first fiber bundle 130.

Figure 15:
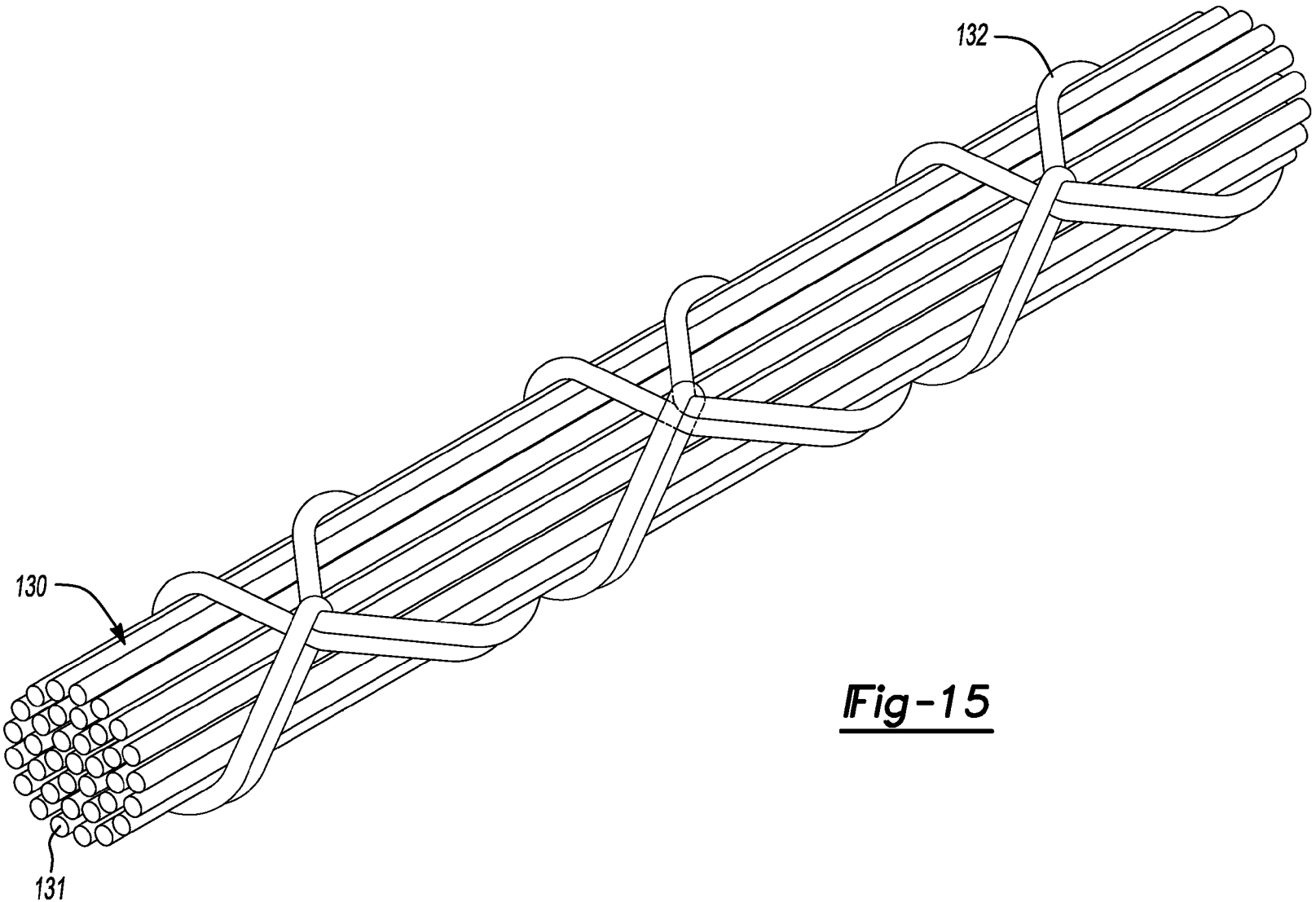
FIG. 15 is a perspective view of a woven member including a single thread in another embodiment according to the principles of the present disclosure.

With reference to FIG. 15, a first fiber bundle 130 is shown including a first thread 132 that may be wrapped around the first fiber bundle 130 in an orientation that does not require the use of a second thread. The first fiber bundle 130 is shown in a round cross-sectional shape but the first fiber bundle 130 may be any cross-sectional shape, such as flat (ribbon like), rectangular, oval, or any suitable shape known in the art. The first fiber bundle 130 contains a plurality of fiber strands 131. The plurality of fiber strands 131 may be aligned adjacently and held together by at least one of a first thread 132 and a second thread 134. The plurality of fiber strands 131 may be held together using an adhesive material. Alternatively, the plurality of fiber strands 131 may be woven together. Weaving the plurality of fiber strands 131 may eliminate the need for an adhesive or a first thread 132. The plurality of fiber strands 131 may be held together in any suitable manner known in the art.

The first thread 132 may include carbon fibers, Kevlar fibers, fiberglass, carbon fibers, poly-parapheneylene tetraphthalamide, para-aramid nylon, aramid fiber, aromatic polyamide, and combinations thereof or other suitable man made and naturally occurring threads that exhibit satisfactory strength and flexibility characteristics.

What is claimed is:

1. A road surface overlay system, comprising:

a road surface;

an adhesive material applied to the road surface;

a woven member including a series of longitudinal carbon fiber bundles and a series of transverse carbon fiber bundles in contact with the series of longitudinal carbon fiber bundles, the woven member being rigidified with a pre-cured epoxy material, the transverse and longitudinal carbon fiber bundles being spaced from adjacent parallel carbon fiber bundles by at least 1/32 of an inch, each of the carbon fiber bundles substantially embedded in the adhesive material; and a layer of aggregate applied onto the woven member and the adhesive material as the uppermost surface of the overlay system.

2. The road surface overlay system according to claim 1, wherein the woven member includes a thread wrapped around each of the longitudinal and transverse carbon fiber bundles.

3. The road surface overlay system according to claim 1, wherein said series of longitudinal carbon fiber bundles are aligned in a first direction and woven with said series of transverse carbon fiber bundles, which are aligned in a second generally perpendicular direction.

4. The road surface overlay system according to claim 1, wherein the layer of aggregate includes a series of peaks, voids, and valleys.

5. The road surface overlay system according to claim 1, further comprising:

a second layer of adhesive material applied to the layer of aggregate.

6. A method of forming a road surface overlay system, the method comprising:

applying an epoxy adhesive to a desired area of the road surface;

applying a woven member on to the epoxy adhesive while the epoxy adhesive remains uncured, said woven member including a series of longitudinal carbon fiber bundles and a series of transverse carbon fiber bundles in contact with the series of longitudinal carbon fiber bundles, the woven member being rigidified with a pre-cured epoxy material, the transverse and longitudinal carbon fiber bundles being spaced from adjacent parallel carbon fiber bundles by at least 1/32 of an inch to allow the epoxy adhesive to flow therebetween; and applying a layer of aggregate onto the woven member and the uncured epoxy adhesive as the uppermost surface of the overlay system.

7. The method according to claim 6, wherein said series of longitudinal and transverse carbon fiber bundles include a thread wrapped therearound.

8. The method according to claim 6, further comprising:

cleaning the road surface before applying the epoxy adhesive.

9. The method according to claim 6, wherein the cleaning includes at least one of etching, steam cleaning, acid washing, sand blasting and power washing.

10. The method according to claim 6, further comprising:

applying at least one of a second layer of epoxy adhesive and a water proofing material over the layer of aggregate, the woven member, and the epoxy adhesive.

11. A road surface overlay system, the system comprising:

a road surface;

an adhesive material applied to the road surface;

a woven member applied to the adhesive material while the adhesive material remains uncured, said woven member including a series of longitudinal fiber bundles and a series of transverse fiber bundles in contact with the series of longitudinal fiber bundles, the woven member being rigidified with a pre-cured epoxy material, the transverse and longitudinal fiber bundles being spaced from adjacent parallel fiber bundles by at least 1/32 of an inch to allow the epoxy adhesive to flow therebetween; and a layer of aggregate applied to the adhesive material while the adhesive remains uncured, said layer of aggregate defining an uppermost surface of the overlay system.

12. The system according to claim 11, wherein said series of longitudinal and transverse fiber bundles each include a thread wrapped therearound.

13. The system according to claim 12, wherein one of the series of longitudinal and transverse fiber bundles comprises at least one of carbon fibers, poly-parapheneylene tetraphthalamide, para-aramid nylon, aramid fiber, aromatic polyamide, and combinations thereof.

14. The system according to claim 12, wherein the thread comprises at least one of carbon fibers, poly-parapheneylene tetraphthalamide, para-aramid nylon, aramid fiber, aromatic polyamide, and combinations thereof.

15. The system according to claim 11, wherein the adhesive material is one of epoxy, urethane sealant, silicone sealant and combinations thereof.

16. The system according to claim 11, wherein the road surface is part of a bridge structure.

17. The system according to claim 11, further comprising:

a second layer of adhesive material applied to the layer of aggregate.

18. The system according to claim 12, wherein at least one of the first and second bundles of fibrous material are precoated with the adhesive material and cured.

* * * * *